US005887826A

United States Patent [19]

Schob

[11] Patent Number: 5,887,826

[45] Date of Patent: Mar. 30, 1999

[54] CAPTIVE GUIDED KIT

[76] Inventor: Martin Schob, Mozartstrasse 9, D-79312 Emmendingen, Germany

[21] Appl. No.: 803,904

[22] Filed: Feb. 21, 1997

[30] Foreign Application Priority Data

Feb. 22, 1996 [DE] Germany ..... 196 06 430.9

[51] Int. Cl.[6] ..... B64C 31/06

[52] U.S. Cl. ..... 244/153 R

[58] Field of Search ..... 244/153 R, 155 R, 244/155 A, 154; D21/88

[56] References Cited

U.S. PATENT DOCUMENTS

| | | | |
|---|---|---|---|
| 2,507,777 | 5/1950 | Frey | 244/153 R |
| 4,015,803 | 4/1977 | Temple | 244/153 R |
| 4,807,832 | 2/1989 | Tebor | 244/153 R |
| 5,328,134 | 7/1994 | Powers | 244/153 R |
| 5,556,057 | 9/1996 | Davies | 244/155 A |

*Primary Examiner*—Galen L. Barefoot
*Attorney, Agent, or Firm*—Charles W. Calkins; Kilpatrick Stockton LLP

[57] ABSTRACT

The invention relates to a captive guided kite (1) featuring a sail (2) whose shape is maintained by means of a rod that features at least one central spar (5) oriented from nose (3) to tail (4) of guided kite (1), and arranged in the central longitudinal region between two wing sides (6, 7), whereby attached to the underside of the kite are cords (13) to control guided kite (1). In order to improve the overall flying behaviour of the captive guided kite (1), and to achieve desired flight speed reduction, it is proposed that sail (2) have a shape, at least in the tail region and longitudinally with central spar (central spars) (5), that departs from the elongated shape towards the upper side of the kite (see FIG. 1*a*).

21 Claims, 6 Drawing Sheets

Figure 1A:
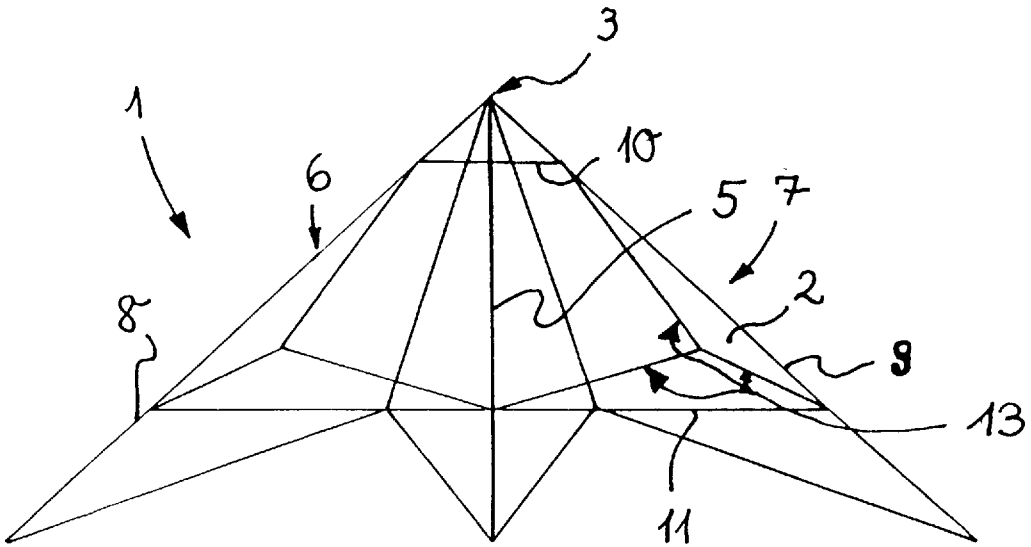

1
2
3
4

CAPTIVE GUIDED KIT

The invention relates to a captive guided kite which, being embodied as a delta kite, has a sail whose shape is maintained by means of a rod that features at least one central spar which, being oriented from the nose to the tail of the guided kite, is arranged in the central longitudinal region located between two wing sides, whereby cords for controlling the guided kite attach to the underside of the kite, and whereby, in the region of the wing sides and on the tail-side, the sail is raised above the central spar by means of spacing rods that impart to the sail a preferably tetrahedral basic shape.

A variety of designs of the captive guided kite of the type mentioned above are known in the art. For example, a so-called delta guided kite features an essentially triangular sail. The sail of the prior art delta guided kite is held in shape by means of a rod that features a central spar that is oriented from the nose to the tail of the guided kite. Attached to the rod arranged on the underside of the kite are pull-and-control cords that permit the delta guided kite to be controlled when airborne.

In the prior art delta guided kite, the central spar of the rod is arranged more or less centrally between two wing sides, provided at the free outer edges of which are rod pockets into each of which is inserted a wing rod that is oriented in the direction of the nose of the guided kite. The wing rods, which are provided on both sides of the guided kite, as well as the central spar, which is arranged more or less centrally, are separated from each other by means of at least one similarly rod-shaped brace that is arranged more or less at right angles to the central spar, and is attached to the latter as well as to the wing rods by means of elastic connectors. In this arrangement, the sail edge of both wing sides in the tail region is raised up by means of at least one brace or so-called stand-off that is oriented toward the upper side of the kite and sits on top of the brace.

This arrangement imparts to the prior art delta guided kite substantially the basic shape of two tetrahedrals that juxtapose each other along their edges, whereby the tips of the tetrahedrals converge toward the nose of the guided kite, and whereby the sail in the region of each wing side forms two equilateral triangles.

In order to enable the prior art guided kites to execute trick flying or stunt routines, good kite control is essential. Thus, a guided kite should neither fly too fast nor accelerate when flying at an angle into oncoming airstreams, or when circling. A guided kite should be distinguished by good straight-flight characteristics, and at the same time be easy to control when flying in and out of curves. Finally, this type of guided kite should have good take-off and landing capabilities.

After it had been found difficult to reconfigure the basic design of this type of delta guided kite, piecemeal improvements were made, an example of which was to cut a number of segments or so-called vents out of the sail, and replace these segments with air-permeable gauze, which would permit these kites to be flown even in high winds. Gauze strips, referred to as "nappies" or "diapers", have also been used, and serve to connect together both control cords in the region of the kite while acting as a wind brake. In order to reduce flight speed, a guided kite having a double sail was developed, which, by creating a low pressure region between the two sails, acted as an air brake. Such modifications affect only a few of the flight characteristics of these prior art guided kites, without however, optimising their overall flight behaviour.

In DE-GM 90 02 912 is disclosed a captive guided kite embodied as a delta kite. In this prior art delta kite, each of the tautening rods arranged on the transverse strut run along both sides of the central spar through an eye made in the sails. Arranged so as to be able to slide along each tautening rod is an adjustment element that permits, by means of the longitudinal sliding of such adjustment elements, the outward curvature of the sail to be adjusted to different wind speeds. By varying and adjusting the outward curvature of the sail, the prior art delta kite can be brought into a fully stable flight condition. Nonetheless, the ability of this kite to perform trick flight manoeuvres has not been improved. DE-OS 26 04 216 discloses a guided kite that can be guided by means of a balance comprising a plurality of guide cords. The sail of this prior art guided kite is kept stretched essentially by means of a centrally located central spar and a transverse brace that forms a cross with the latter. In this arrangement, the tail-side end of the central spar is angled in the direction of the upper side of the kite and so forms a rudder that can pivot from side to side with the aid of a control rod attached at an angle to the central spar. Although the rudder of the prior art guided kite permits its flight position to change relative to the air stream, this type of kite construction can neither even out the flight speed nor improve stunt flying characteristics.

US-PS 22 03 150 discloses a kite, the shape of whose sail is maintained by means of two rods arranged in the form of a cross. The sail of this prior art kite is divided into a frontal stabilisation surface as well as a rear mainsail surface, which between them delimit an air flow-through opening. The flight characteristics of this prior art kite are supposed to be stabilised by means both of a bow-shaped bend in the cruciform rods and the air flow-through opening created between the sail surfaces.

A captive kite is also known in the art, the sail of which is also kept taut by means of crossed rods, one of which, being arranged in the longitudinal direction of the kite, is bent into the shape of a loop to form a double central spar (compare with FIG. 6 of DE-OS 20 30 549). While the apex of the central spar is oriented in the flight direction by means of the loop-shaped bend, its free spar ends, which are separated from each other, are arranged on the tail side. This prior art kite is supposed to be used in low wind conditions, and its rounded kite tip should be able to withstand impacts.

DE-OS 14 78 649 discloses a variety of captive kites whose rods, in cruciform arrangement, act to tauten the sail and are bent concavely upward but, when viewed from beneath, appear to be convex. These rods, which also maintain the concave contour of the sail both laterally and in the longitudinal direction, possess, at the wing ends, uniformly toward the top and the front, sloping stabilising surfaces that are bent toward the back and toward the front like arms that give this kite a bird-like appearance. The prior art kite in accordance with DE-OS 14 78 649 is supposed to be distinguished by high load-bearing capability, by the elasticity of its components, and by good flight characteristics. Like the arrangements described in US-PS 22 03 150 and in DE-OS 20 30 594 however, the captive kite disclosed by DE-OS 14 78 649 is even less suited to stunt flying than the delta kite described above.

The object of the invention, therefore, is the creation of a captive guided kite of the type first mentioned, which, being distinguished by overall very good flight behaviour, can fly at comparatively reduced speed even when meeting air streams at a variety of angles, possesses good curve handling, take-off and landing characteristics, and particularly good stunt flying characteristics.

This problem is addressed in a captive controlled kite of the type first mentioned, wherein the sail, at least in the region of the tail and longitudinally along the central spar (the central spars) deviates from an elongated shape towards the upper side of the kite to form an air pocket, and that the tail-side wing edge of each wing side features a taut contour between the central spar on the one side, and the spacing rods on the other side.

In the proposed kite, the sail is oriented toward the upper side of the kite, at least in the region of the tail. Thus, the sail in the tail region essentially forms an air pocket, which serves to even out the air speed of the kite, even in the face of varying air stream angles, and if necessary brings the kite to a stop. Being open toward the top in the region of the tail, the sail in this region also assumes an increasing braking role when winds of increased speed flow very close over the underside of the kite and flight speed increases commensurately, while at lower wind speeds flying in the lee side, and having a comparatively reduced braking effect. Such evening out of the flight speed optimises the stunt-flying characteristics of the proposed guided kite.

In a reverse take-off situation, or when executing a trick flight figure, in which the kite is brought out of a normal flight position by means of a jerking motion on the control lines into a flat position as viewed by the pilot, the sail, which is raised up in the tail area, acts practically like a horizontal tail unit. In curve flying, on the other hand, this sail region essentially assumes the role of a rudder unit as it stabilises flight motion in straight flight. The sail, oriented upwardly in the tail region, thus advantageously influences the overall flight behaviour of the proposed captive guided kite. Since the tail region in the proposed guided kite no longer protrudes toward the rear, the guide cords are prevented from getting caught, which is a distinct advantage in trick flying.

In order to enlarge the raised partial surface of the sail, at least in the tail region, it can be useful if the captive guided kite possesses a plurality of, and preferably two central spars that are separated from each other and arranged in the longitudinal central region of the guided kite. The enlarged, raised partial surface of the sail reinforces the air pocket effect described above, which further facilitates the desired braking action.

A particularly advantageous embodiment of the invention that has particular inventive merit comprises that at least one of the central spars that stiffens the sail has, at least in the tail region, a course that is bent or angled in the direction of the upper side of the kite. The central spar, which both tightens and lies against the sail, also deforms the latter in the tail region in the direction of the upper side of the kite. In this way, the central spar can be bent curve-like, at least, for example, in the tail region, toward the upper side of the kite.

In order to impart to the central spar in the tail region a bent or angled shape, it is useful if the central spar comprises, at least in the tail region, an elastic material. For this purpose, a preferred embodiment according to the invention provides that in the tail region the central spar is stressed in the direction of the upper side of the kite by means of the sail that attaches to the tail-side spar end. In this embodiment, the dimension and shape of the sail in the tail region are such that the central spar can also be stressed in the direction of the upper side of the kite.

Another embodiment of the invention provides that the central spar is bent toward the upper side of the kite, at a distance from the tail-side spar end. By means of the central spar that is angled upward at a distance from the spar end, which is on the tail side, the sail in this region can depart from an elongated shape in the direction of the upper side of the kite. In this arrangement, it can be advantageous if the partial region of the central spar, which is bent upwards towards the upper side of the kite, is somewhat concavely bent as seen from the underside of the kite, and provides for a similarly concave sail-shape in the tail region.

A further modification in accordance with the invention comprises that the central spar essentially over its entire longitudinal length has a curved, and as seen from the underside of the kite, particularly convex course, which also imparts to the sail in the region of the central spar a convex shape. This embodiment is distinguished not only by a particularly attractive appearance, but also by its overall good flight characteristics.

The invention will next be described in greater detail by means of drawings.

Figure 1B:
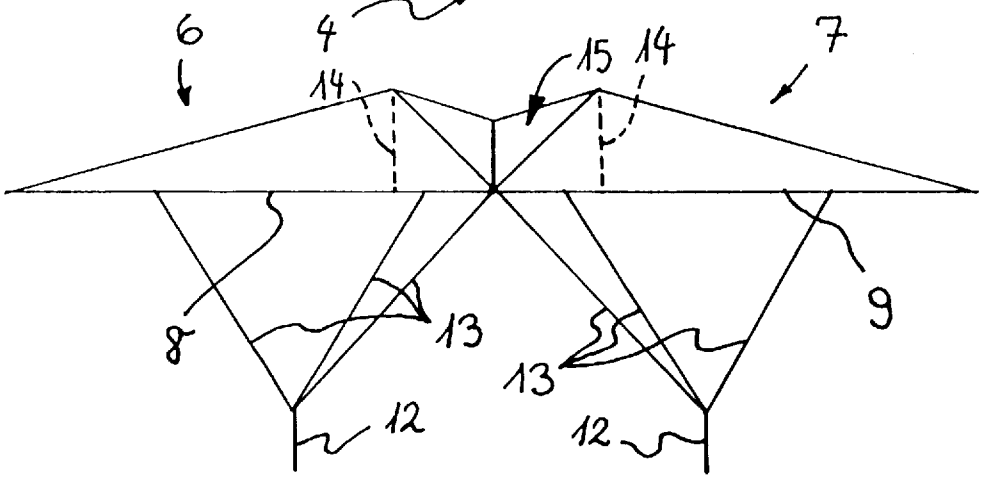

Shown schematically:

FIG. 1 a plan view of a captive guided kite (FIG. 1*a*), as well as a frontal view (FIG. 1*b*), which in its tail region has a sail that is raised toward the top.

Figure 2:
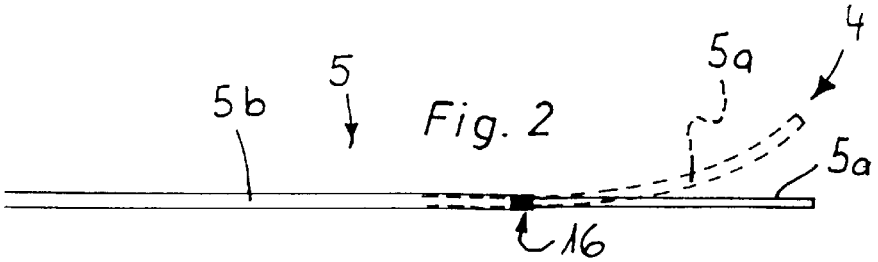

FIG. 2 a central spar for a guided kite, in accordance with FIG. 1, wherein the central spar, in order to give shape to the sail, is curved upward in the tail region.

Figure 3:
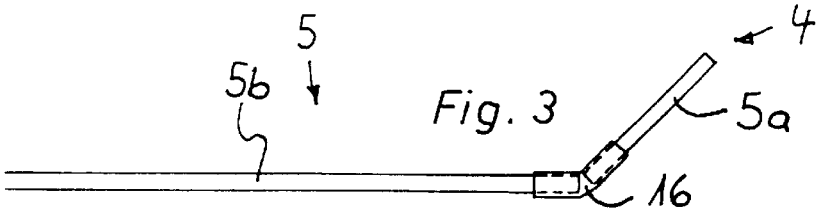

FIG. 3 a central spar similar to that shown in FIG. 2, wherein the central spar is angled upward at a distance from the spar end that is situated on the tail side.

Figure 4:
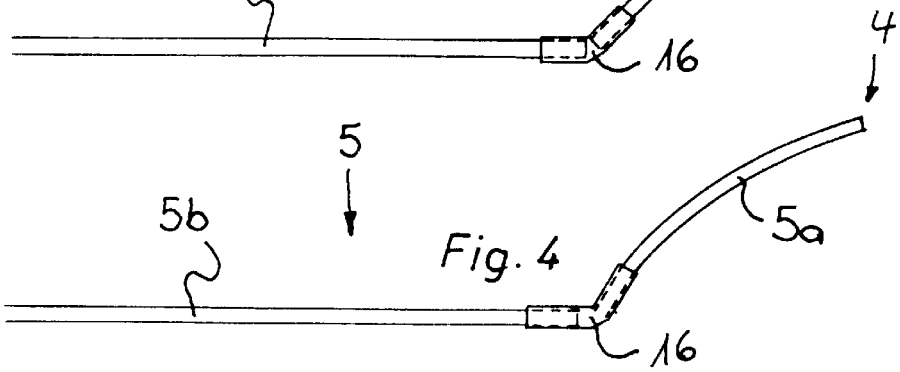

FIG. 4 a central spar of a design similar to that in FIG. 3, wherein the partial region that has been angled upward on the side of the tail is shaped concavely towards the inside.

Figure 5A:
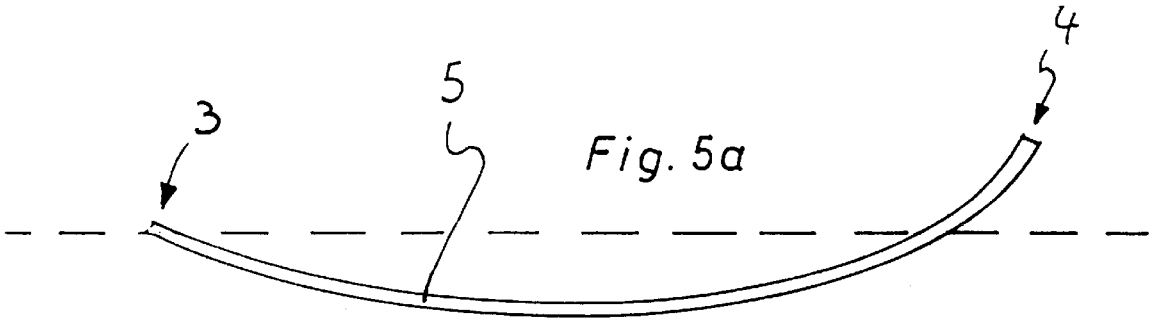
Figure 5B:
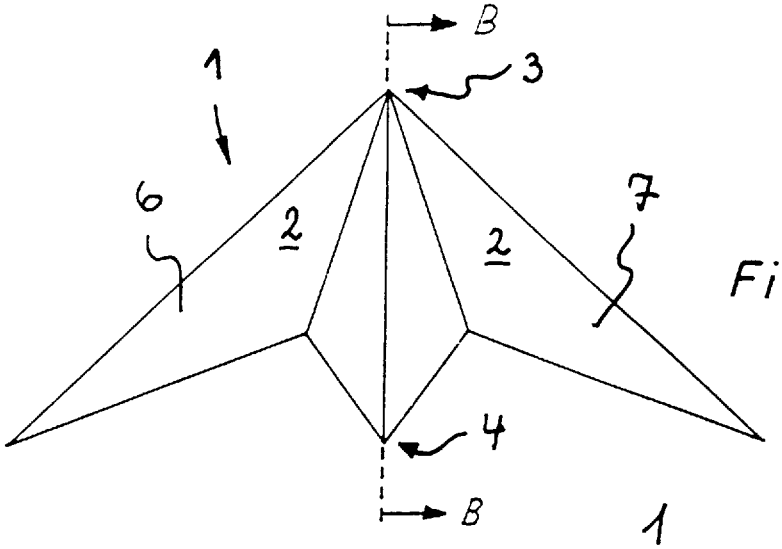
Figure 5C:
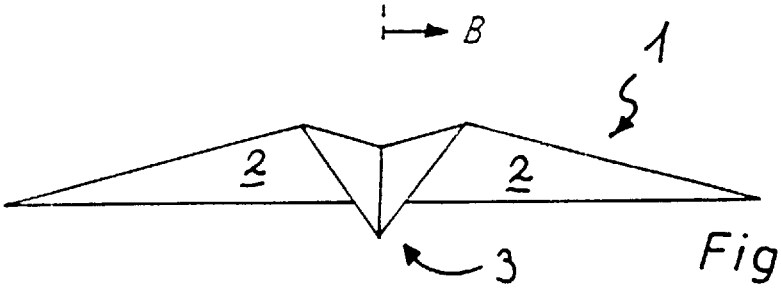
Figure 5D:
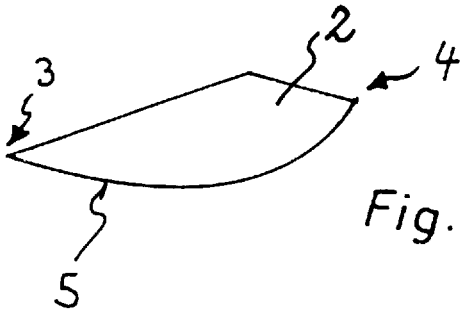

FIG. 5 a plan view of a captive guided kite (FIG. 5*b*), a frontal view (FIG. 5*c*), as well as a partial view (FIG. 5*d*) along section line B—B from FIG. 5*b*, the central spar of which (FIG. 5*a*) is bent in the shape of a curve over its entire length, and whereby a convex shape is imparted to the sail that sits thereupon and that is kept taut by the central spar.

FIG. 6 captive guided kite from FIG. 1 at reverse take-off.

FIG. 7 captive guided kite from FIG. 1 while executing a flight figure.

FIG. 8 a captive guided kite, similar to that shown in FIG. 1, wherein the guided kite in FIG. 8 comprises central spars that are slightly spaced from each other in the central region and converge at least at the nose as well as at the tail of the guided kite.

Shown in FIGS. 1*a* and 1*b* is a captive guided kite in which FIG. 1*a* is a plan view of the underside of the kite and FIG. 1*b* a frontal view of such kite. Captive guided kite 1 is embodied in this configuration as a so-called delta kite, and features a sail 2 that is essentially triangular in shape. The shape of sail 2 of guided kite 1 is maintained by means of a rod that comprises at least one central spar 5 that is oriented from nose 3 to tail 4 of guided kite 1. Central spar 5 is arranged more or less centrally between two wing sides 6, 7. The wing edges, which are oriented towards nose 3 of guided kite 1, are each stiffened by means of a wing rod 8, 9, each of which is inserted into a rod pocket of sail 2 that is located at the edge. Attaching to central spar 5 as well as to wing rods 8, 9, which are situated at the edges, are an upper as well as a lower brace 10, 11, which braces 10, 11 are also embodied in the shape of rods, and act to brace both central spar 5 and wing rods 8, 9.

Attached to the rods provided on the underside of the kite, in accordance with FIG. 1*a*, are guide cords 12 that are illustrated in FIG. 1*b*. In this arrangement, each of wing sides 6, 7 is attached to a guide cord 12, each of which is attached to its corresponding wing side 6, 7, by means of a three-point cord arrangement that is embodied as a balance 13.

It can be seen in FIG. 1*b* that each wing edge, which is located on the tail side of each wing side 6, 7, is raised by means of at least one spacing rod 14 (so-called stand-off) toward the upper side of the kite. These spacing rods 14 are arranged at a distance from central spar 5 on one side, and neighboring wing rods 8, 9 on the other side.

Sail 2 of the guided kite described in FIGS. *a* and 1*b* at least in the tail region along a central spar 5, departs from an elongated shape towards the upper side of the kite, and sail 2 in the tail region effectively forms an air pocket 15, which can be clearly seen in FIG. 1*b*. Air pocket 15, which is formed by sail 2, acts to brake the guided kite when flying into airstreams approaching at a variety of angles, thus evening out its flight speed.

Since sail 2 is open toward the top in its tail region, its braking effect in the tail region is also improved in the event of increased wind speed close to the underside of the kite and accordingly increased flight speed, while the raised sail in the tail region is situated in a lee at reduced wind speeds, and has comparatively less braking effect. The evening out of the flight speed also optimises the stunt flight characteristics of guided kite 1.

In this arrangement, it is advantageous if central spar 5, which stiffens sail 2, has a curved or bent course toward the upper side of the kite at least in the tail region, as shown in FIGS. 2 to 5.

Shown in FIGS. 2 and 5 in two different configurations, is a central spar 5 in which central spar 5 is curved toward the upper side of the kite, at least in the tail region. In this arrangement, central spar 5 can comprise a dimensionally-stable and suitably bent rod of material. The central spar can also comprise an elastic material, at least in its sub-region that has been bent into a curve, and as indicated in FIG. 2, stressed on the tail side in the direction of the upper side of the kite by means of sail 2 that attaches to the spar end.

As indicated in FIG. 2, rod-shaped central spar 5 features two rod or spar sections 5*a* and 5*b* that are connected together by means of a conventional tubiform connector 16 comprising elastic material. Of spar sections 5*a* and 5*b*, spar section 5*a*, located on the tail side, comprises an elastic rod material, for example, a flexible fibreglass rod, while spar section 5*b*, located near the nose, comprises preferably a dimensionally-stable material, for example, of rigid carbon fibre rod.

Shown in FIGS. 3 and 4 are two further configurations of a central spar 5 that has been angled toward the upper side of the kite at a distance from the tail-side spar end. In this arrangement, central spar 5 in FIGS. 3 and 4 feature two spar sections 5*a* and 5*b* that are connected to each other by means of a connector 16 which, comprising dimensionally-stable material, acts as a bending point. Whereas each of spar sections 5*a* and 5*b* of the central spar illustrated in FIG. 3 exhibits an elongated form, spar section 5*a* of central spar 5 illustrated in FIG. 4 is curved somewhat concavely. While the spar shown in FIG. 3 can feature two spar sections 5*a* and 5*b* comprising carbon fibre rods, spar section 5*a* of the spar shown in FIG. 4, which is located on the tail side, can, as shown in FIG. 4, comprise a rigid pre-formed rod or a flexible rod that is deformed into a concave curve with the aid of the sail, a tightening string or similar element.

As FIGS. 5*a* to 5*d* illustrate, it is also possible for central spar 5 to have an essentially curved shape and especially convex course, essentially over its entire length. Thus, when guided kite 1 is in the horizontal position, the tail-side spar ends featured in FIGS. 5*a* and 5*d* project past the nose-side spar end of central spar 5 toward the upper side of the kite. It will, of course, be appreciated that central spars 5, illustrated in FIGS. 2 to 5, exhibit an external contour that fits against the appropriately cut and sewn sail 2 that lies against central spar 5.

Figures 6A, 6B, 6C:
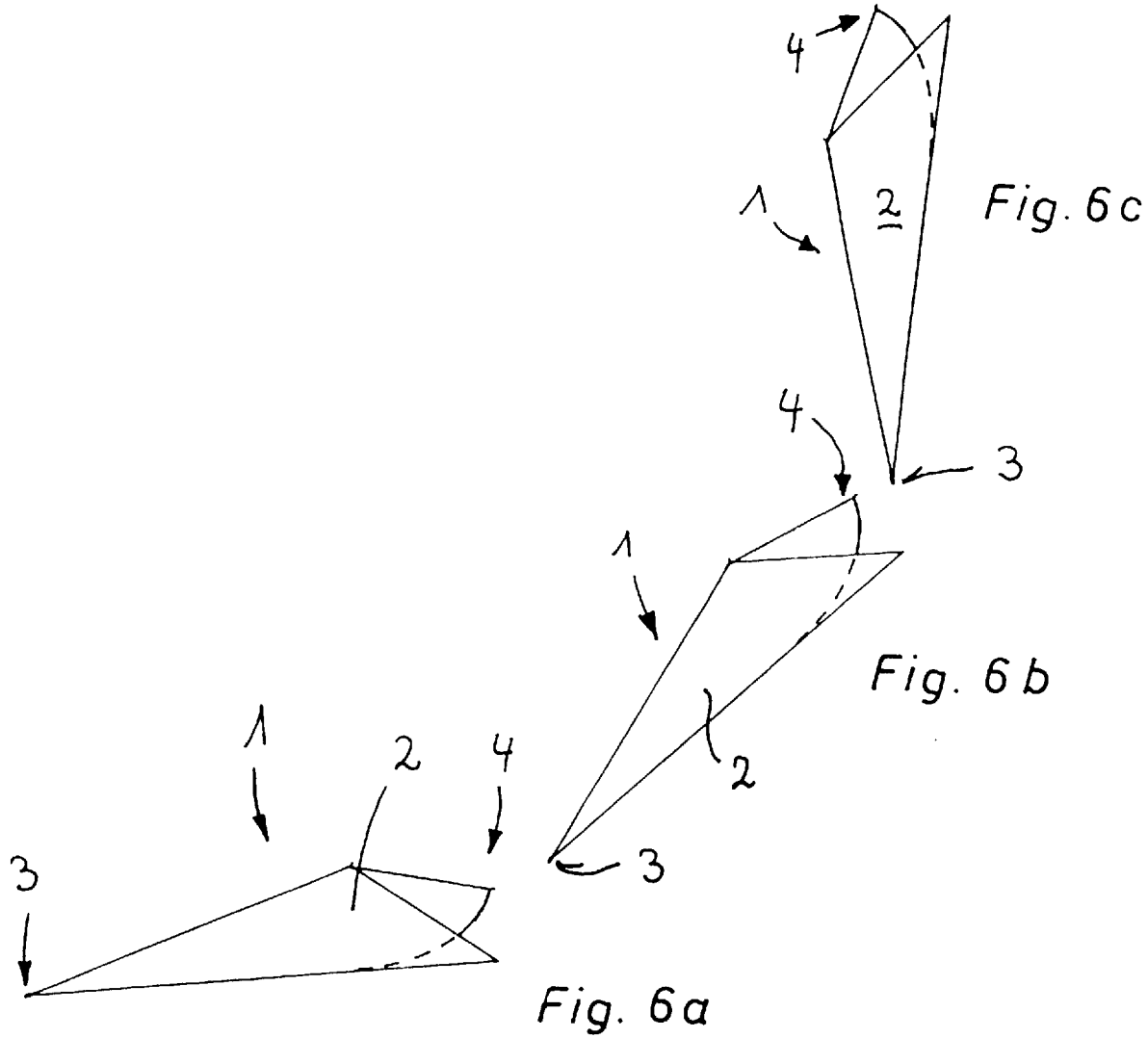

Captive guided kite 1 is distinguished by particularly good overall flight behaviour. In FIG. 6, a guided kite 1 is shown lifting off backwards from a ground position. In this configuration, the tail region (FIG. 6*b*) of the guided kite is lifted up by jerking and pulling on the guide cords, which brings the guided kite into a flyable position (FIG. 6*c*). Similarly, a guided kite 1, which is lying flat in the air, as in FIG. 6*a*, can be brought into the flight position shown in FIG. 6*b*. Sail 2, which is raised up at least in the tail region, acts thus effectively as a horizontal tail unit, which greatly facilitates lifting the kite.

Figures 7A, 7B, 7C:
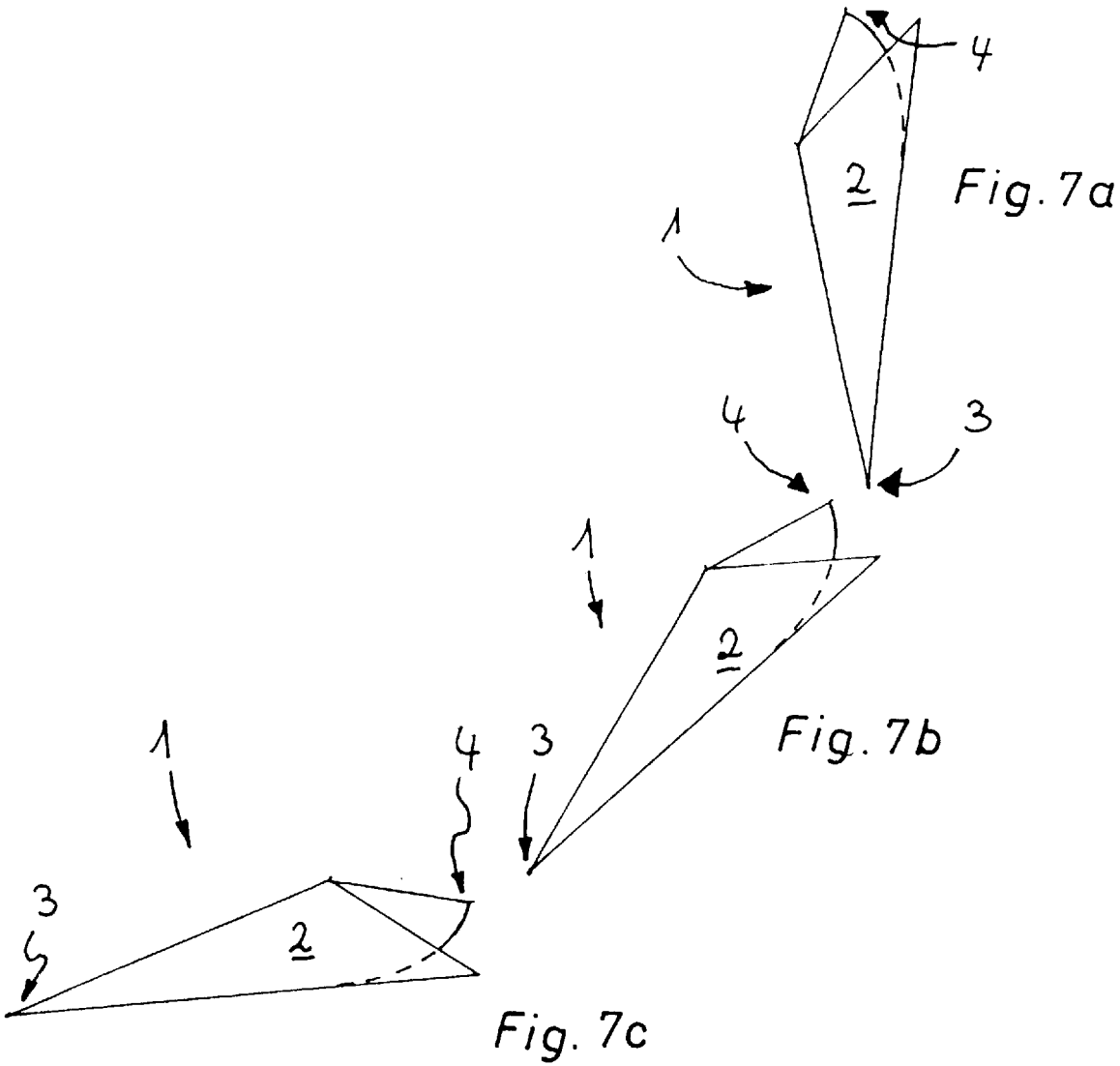

As indicated in FIG. 7, guided kite 1 can be brought into a flat flying position, as viewed by the pilot, and illustrated in FIG. 7*c*, by means of comparatively slight jerking motion and short tugs on the guide cords, as shown in FIG. 7*a*, whereby in this configuration also, the raised tail 4 of guided kite 1 acts as the lift rudder of an aeroplane.

In curve flying, on the other hand, raised tail region 4 of guided kite 1 acts practically like a rudder unit and also stabilises the straight flight characteristics of guided kite 1. In addition, this arrangement prevents guide cords 12 from getting caught on tail 4 of guided kite 1 during trick flying, since tail 4 no longer protrudes, a distinct and noticeable advantage whenever stunts are executed.

Figure 8A:
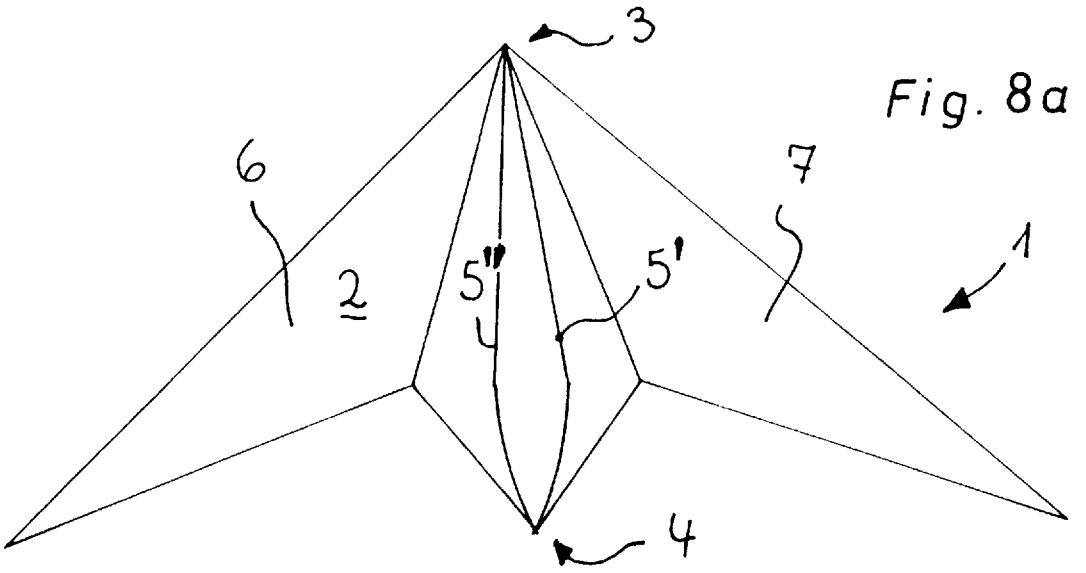
Figure 8B:
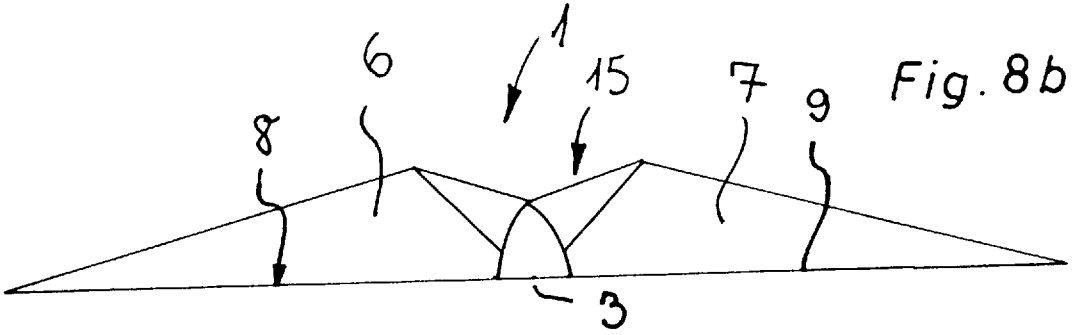

Shown in FIG. 8 is a captive guided kite 1 in plan view (FIG. 8*a*), as well as in frontal view (FIG. 8*b*). As FIG. 8 shows, guided kite 1 can feature a plurality, and in this configuration, two central spars 5 that are arranged more or less in the longitudinal central region between wing sides 6 and 7. By means of the central spars 5', 5" that are separated from each other in the central region and converge at least at nose 3, the sail surface of sail 2 is enlarged in the tail region, and the air pocket effect described above is advantageously enhanced. In FIG. 5, central spars 5', 5" also converge at tail 4, but it is also possible in this case for spars 5', 5" to run parallel and be separate from each other.

In order to prevent guided kite 1 from fluttering excessively and producing noise during flight, it is advantageous if, on the tail-side, the wing edge of each wing side 6, 7 feature a taut shape between the central spar on the one hand and the stand-off braces on the other side, in which case a curved and especially concave contour can be imparted to this wing edge.

Both the size and angle of sail 2, or of central spar 5, which are bent in a curve or angled toward the upper side of the kite, can, depending on kite design, be produced in either a low wind or high wind version. Sail 2, which is raised in the tail region, substantially improves precision flying characteristics, so that guided kite 1 can be used to advantage in precision team and stunt flying. Guided kite 1 is thus distinguished by a comparatively broad applicability. In addition, sail 2, which is raised in the tail region, advantageously gives the guided kite a novel visual shape and appearance.

I claim:

1. Captive guided kite (1), embodied as a delta kite and possessing a sail (2), which is held in shape by means of a rod that features a central spar (5) that is oriented at least from nose (3) to tail (4) of guided kite (1), and is arranged in the central longitudinal region between two wing sides (6, 7), whereby attached to the underside of the kite are cords (12) for controlling guided kite (1), and whereby sail (2) is raised on the tail-side in the region of wing sides (6, 7) and is separated from central spar (5) by means of spacing rods to assume a preferably tetrahedral basic shape, characterised in that sail (2) has, at least in the tail region, along central spar (central spars) (5), a shape that departs from an elongated shape in the direction of the upper side of the kite, thus forming an air pocket (15), and that the tail-side wing edge of each wing side exhibits a taut contour between central spar (5) on one side and the spacing rods (14) on the other side.

2. Captive guided kite, in accordance with claim 1, characterised in that captive guided kite (1) has a plurality, preferably two central spars (5', 5") that are separated from each other and arranged in the central longitudinal region of guided kite (1).

3. Captive guided kite, in accordance with claim 2, characterised in that central spar (5), of which there is at least one, which tautens the sail (2), has a course that is curved or bent toward the upper side of the kite, at least in the tail region.

4. Captive guided kite, in accordance with claim 1, characterised in that central spar (central spars) (5) is (are) curved toward the upper side of the kite, at least in the tail region.

5. Captive guided kite, in accordance with claim 1, characterised in that central spar (central spars) (5), comprises (comprise) an elastic material, at least in the tail region.

6. Captive guided kite in accordance with claim 1, characterised in that central spar (central spars) (5), is (are) stressed in the direction of the upper side of the kite in the tail region, by means of sail (2), which attaches to the tail-side spar end.

7. Captive guided kite, in accordance with claim 1, characterised in that central spar (central spars) (5), is (are) bent toward the upper side of the kite, at a distance from the tail-side spar end.

8. Captive guided kite, in accordance with claim 1, characterised in that the partial region(s) of central spar (central spars) (5), which is (are) curved or bent toward the upper side of the kite, are somewhat concavely curved, as viewed from the underside of the kite.

9. Captive guided kite, in accordance with claim 1, characterised in that central spar (central spars) (5) have at least two spar sections (5*a*, 5*b*), which are connected together by means of a connector (16), and that spar section (5*a*) is curved or bent toward the upper side of the kite, preferably in the region of connector (16).

10. Captive guided kite in accordance with claim 1, characterised in that central spar (central spars) (5) has (have) a curved course, and, especially, as viewed from the underside of the kite, a convex shape, essentially over its (their) entire length.

11. Captive guided kite, in accordance with claim 1, characterised in that when guided kite (1) is in the horizontal position, the tail-side spar end of central spar (central spars) (5), projects beyond its (their) nose-side spar end in the direction of the upper side of the kite (12).

12. Captive guided kite in accordance with claim 1, characterised in that the tail-side wing edge of each wing side (6, 7) features a curved shape, and in particular as seen from the underside of the kite, a concave contour between central spar (5) on one side and the spacing rods (14) on the other side.

13. A kite comprising:

a sail including a plurality of wing edges;

a rod providing a shape to the sail, the rod including a central spar which is concavely curved toward the upper side of the kite as viewed from the underside of the kite, oriented at least from nose to tail of kite and arranged in the central longitudinal region between two wing edges;

spacing rods which raise the sail on the tail-side in the region of the wing sides and separate the sail on the tail-side in the region of the wing sides from the central spar giving the kite a tetrahedral shape so that the tail-side wing edge of each wing side exhibits a taut contour between central spar on one side and the spacing rods on the other side, and an air pocket formed as a result of the tetrahedral shape formed by the spacing rods.

14. The kite of claim 13 wherein the central spar is composed of a plurality of sub-spars, each being separated from each other and arranged in the central longitudinal region of the kite.

15. The kite of claim 13 wherein the central spar comprises in at least some portion thereof an elastic material.

16. The kite of claim 13 wherein the central spar is stressed in the direction of the upper side of the kite in the tail region, by means of the sail, which attaches to the tail-side spar end.

17. The kite of claim 13 wherein the central spar is bent toward the upper side of the kite, at a distance from the tail-side spar end.

18. The kite of claim 13 wherein the central spar has at least two spar sections which are connected together by means of a connector, and that spar section in the tail region of the kite is curved or bent toward the upper side of the kite, preferably in the region of connector.

19. The kite of claim 13 wherein the central spar has a curved course, and as viewed from the underside of the kite, a convex shape, essentially over its entire length.

20. The kite of claim 13 wherein the tail-side spar end of the central spar, projects beyond its nose-side spar end in the direction of the upper side of the kite when the kite is in the horizontal position.

21. The kite of claim 13 wherein the tail-side wing edge of each wing side features a curved shape, and as seen from the underside of the kite, a concave contour between central spar on one side and the spacing rod on the other side.

* * * * *

UNITED STATES PATENT AND TRADEMARK OFFICE

CERTIFICATE OF CORRECTION

PATENT NO. : 5,887,826

DATED : March 30, 1999

INVENTOR(S) : Martin Schob

It is certified that error appears in the above-identified patent and that said Letters Patent is hereby corrected as shown below:

On the title page, item [54] col.1, line 1 CAPITIVE GUIDED KITE replace "KIT"
with --KITE--.

Col. 5, line 7
replace "a"
with --1a--.

Signed and Sealed this

Twenty-seventh Day of July, 1999

*Attest:*

Q. TODD DICKINSON

*Attesting Officer*

*Acting Commissioner of Patents and Trademarks*